US009074850B2

(12) United States Patent
Bergiadis

(10) Patent No.: US 9,074,850 B2
(45) Date of Patent: Jul. 7, 2015

(54) BALLISTIC WALL

(76) Inventor: William Lee Bergiadis, Santa Clarita, CA (US)

( * ) Notice: Subject to any disclaimer, the term of this patent is extended or adjusted under 35 U.S.C. 154(b) by 0 days.

(21) Appl. No.: 13/414,478

(22) Filed: Mar. 7, 2012

(65) Prior Publication Data

US 2013/0233163 A1 Sep. 12, 2013

(51) Int. Cl.

| | |
|---|---|
| ***E04F 15/10*** | (2006.01) |
| ***F41H 5/013*** | (2006.01) |
| ***F41H 5/04*** | (2006.01) |
| ***F41H 5/24*** | (2006.01) |
| ***F41J 11/02*** | (2009.01) |

(52) U.S. Cl.

CPC ..... *F41H 5/013* (2013.01); *F41H 5/0471* (2013.01); *F41H 5/24* (2013.01); *F41J 11/02* (2013.01)

(58) Field of Classification Search

CPC ..... F41H 5/013; F41H 5/0471; F41H 5/24; F41J 11/02; E04F 15/10

USPC ..... 52/589.1, 590.1, 590.2, 590.3, 591.1, 52/591.2, 591.3, 591.4, 591.5, 592.1, 52/592.2, 592.3, 592.4, 592.5, 592.6; 89/36.01, 36.02, 36.04, 36.04 X, 36.05, 89/36.07, 36.07 X, 920, 920 X; 181/290

See application file for complete search history.

(56) References Cited

U.S. PATENT DOCUMENTS

| | | | | |
|---|---|---|---|---|
| 2,283,582 | A * | 5/1942 | Scherer | 52/591.2 |
| 4,075,808 | A * | 2/1978 | Pearlman | 52/439 |
| 4,076,246 | A * | 2/1978 | Meyer | 273/404 |
| 4,683,800 | A * | 8/1987 | Snedeker | 89/36.02 |
| 5,230,194 | A * | 7/1993 | McClure | 52/591.4 |
| 5,661,273 | A * | 8/1997 | Bergiadis | 181/290 |
| 6,244,009 | B1 * | 6/2001 | Cerrato | 52/604 |
| 6,247,286 | B1 * | 6/2001 | Heyns | 52/589.1 |
| 6,568,310 | B2 * | 5/2003 | Morgan | 89/36.02 |
| 7,628,104 | B2 * | 12/2009 | Warren et al. | 89/36.02 |
| 7,845,266 | B2 * | 12/2010 | Duke et al. | 89/36.04 |
| 8,141,471 | B2 * | 3/2012 | DeCristofaro et al. | 89/36.02 |
| 8,186,262 | B2 * | 5/2012 | Farquhar et al. | 89/36.01 |
| 8,256,186 | B2 * | 9/2012 | Bryan | 52/831 |
| 8,479,464 | B2 * | 7/2013 | Holzworth | 52/284 |
| 2007/0180982 | A1 * | 8/2007 | Dagher et al. | 89/36.02 |
| 2010/0083819 | A1 * | 4/2010 | Mann et al. | 89/36.02 |
| 2011/0173911 | A1 * | 7/2011 | Propst | 52/309.13 |

* cited by examiner

*Primary Examiner* — Beth S Stephan

(74) *Attorney, Agent, or Firm* — Bennet K. Langlotz; Langlotz Patent & Trademark Works, Inc.

(57) ABSTRACT

Ballistic walls include a plurality of interlocking blocks formed of a bullet-resistant material, a first portion of the periphery of each block having a protruding tongue, a second portion of the periphery of each block defining a groove sized to receive the tongue, and the tongues and grooves of adjacent blocks being mated to each other to form an interlocked structure. Each block may be formed of a stack of panels having a first surface panel, a second surface panel, and an interior panel, wherein the interior panel is offset from the first and second surface panels to form the tongues and to define the grooves. Each block may be formed of a stack of five panels offset from each other. The blocks may be arranged in a running bond, such that the vertical seams of one course are offset from the vertical seams of an adjacent course.

18 Claims, 7 Drawing Sheets

BALLISTIC WALL

FIELD OF THE INVENTION

The present invention relates to walls for stopping and capturing projectiles, and to projectile slowing and capturing elements with sound absorbing properties.

BACKGROUND OF THE INVENTION

Traditionally, outdoor shooting ranges utilize dirt berms to provide side ballistic protection. Although dirt berms are used effectively in this application, they have a number of disadvantages. First, dirt berms must have a 2:1 compacted slope. This means that for every foot of height, the berm must be 2 feet wide. A 16 foot high dirt berm must be 32 feet wide, which occupies a considerable area. Given that two berms are required for sidewall protection, this means that 64 feet must be devoted to the berms alone. Another consequence is the range takes significant time and expense to construct. Furthermore, considerable ongoing expense occurs because the berms must be erosion controlled, periodically the lead projectiles must be removed, and the berms must be re-compacted. These maintenance activities also prevent the range from being used while they occur. Finally, dirt berms have no acoustical absorption value.

Concrete walls or concrete masonry walls are a space-saving alternative to dirt berms that provide similar ballistic protection. However, concrete walls require a substantial footing or foundation because they are heavy. The type of foundation is determined by the wall's height, the wind load, the soil density, and the seismic zone. A standard 16 foot wall designed for a standard 70 mi./h. Wind load in a low seismic zone with normal 2,000 pound density soil requires a foundation approximately 8 feet wide and 3 feet deep. This design increases cost substantially and requires a 28 day cure time. In addition, in order to provide ballistic protection, a minimum of 5,000 PSI concrete is required, which further adds to the wall's cost. This design is time-consuming to construct and much more expensive than dirt berms. Concrete surfaces have no acoustical absorption; instead, they reflect gunfire sound levels. Gunfire sound levels easily reach levels of 145-165 dBA. This energy is reflected off parallel concrete surfaces, in this case the two side walls, which will reflect this gunfire sound level for as long as 8 seconds. This reflected sound level, when added to the actual gunfire sound level, produces very high, unhealthy sound levels that will carry for a length of over ¾ of a mile. This sound level can be very intrusive to neighbors or adjacent buildings within this ¾ mile radius.

Therefore, a need exists for a new and improved ballistic wall that provides ballistic protection with a small footprint, eliminates lead remediation, and absorbs the gunfire sound level. In this regard, the various embodiments of the present invention substantially fulfill at least some of these needs. In this respect, the sound absorbing wall according to the present invention substantially departs from the conventional concepts and designs of the prior art, and in doing so provides an apparatus primarily developed for the purpose of providing ballistic protection with a small footprint and eliminating lead remediation.

SUMMARY OF THE INVENTION

The present invention provides an improved ballistic wall, and overcomes the above-mentioned disadvantages and drawbacks of the prior art. As such, the general purpose of the present invention, which will be described subsequently in greater detail, is to provide an improved ballistic wall that has all the advantages of the prior art.

To attain this, the preferred embodiment of the present invention essentially comprises a plurality of interlocking blocks formed of bullet-resistant material and acoustic sound absorbing material, a first portion of the periphery of each block having a protruding tongue, a second portion of the periphery of each block defining a groove sized to receive the tongue, and the tongues and grooves of adjacent blocks being mated to each other to form an interlocked structure. Each block may be formed of a stack of panels having a first surface panel, a second surface panel, and an interior panel, wherein the interior panel is offset from the first and second surface panels to form the tongues and to define the grooves. Each block may be formed of a stack of five panels offset from each other. The blocks may be arranged in a running bond, such that the vertical seams of one course are offset from the vertical seams of an adjacent course. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
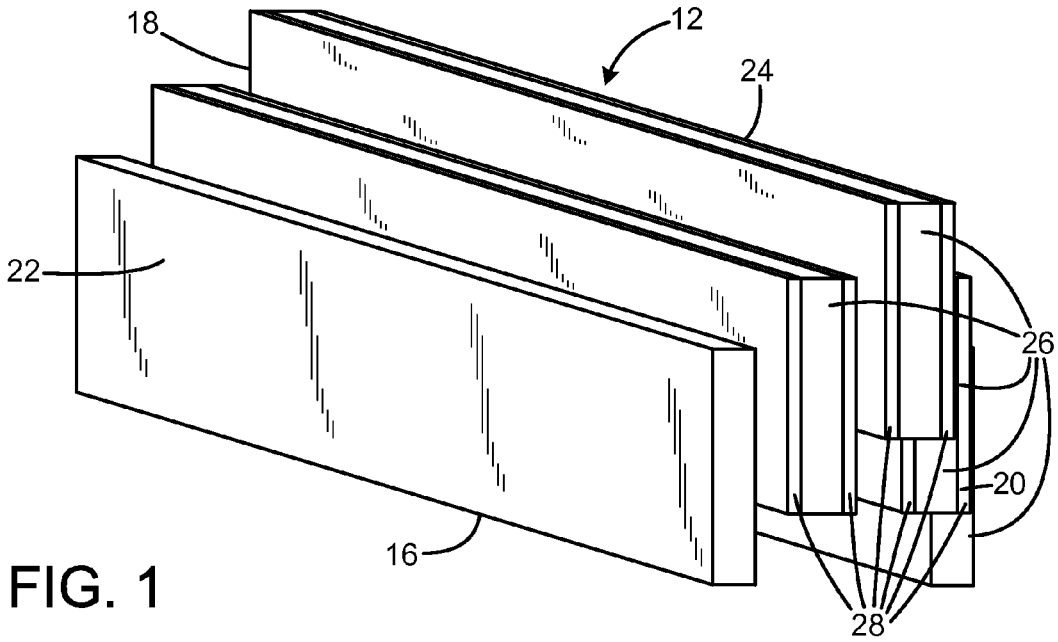
FIG. 1 is a front isometric view of the current embodiment of the panel constructed in accordance with the principles of the present invention.
Figure 2:
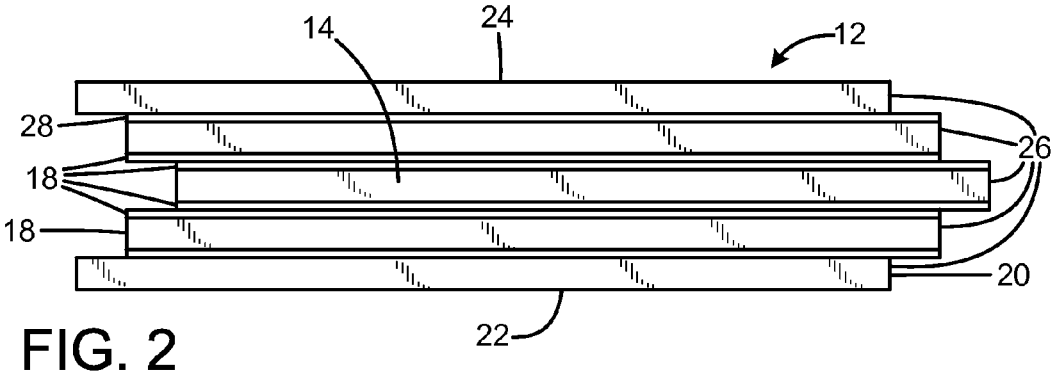
FIG. 2 is a top view of the current embodiment of the panel of FIG. 1.
Figure 3:
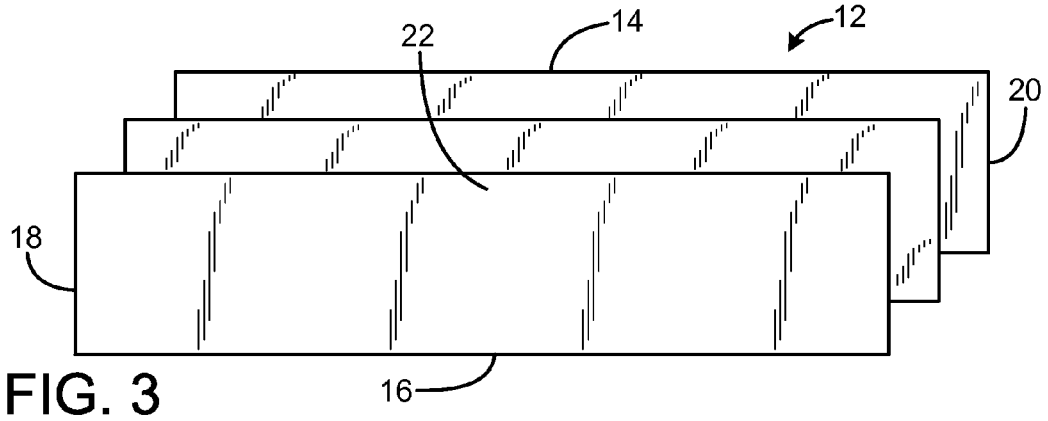
FIG. 3 is a front view of the current embodiment of the panel of FIG. 1.
Figure 4:
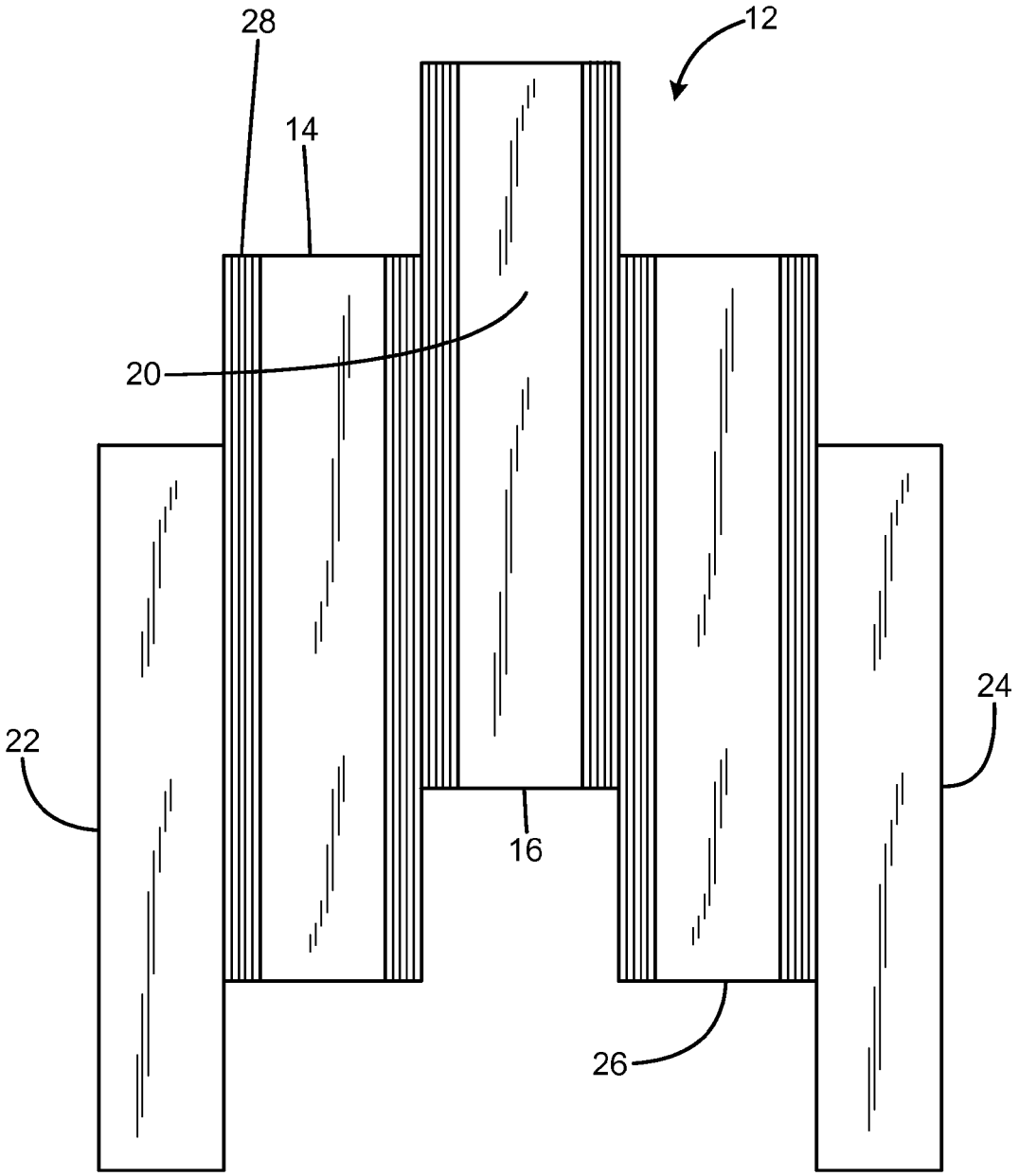
FIG. 4 is a right end enlarged view of the current embodiment of the panel of FIG. 1.

A preferred embodiment of the ballistic wall of the present invention is shown and generally designated by the reference numeral 10.

FIGS. 1-4 illustrate the improved panel 12 of the present invention. More particularly, the panel has a frame 64 having a top 14, a bottom 16, a left side 18, a right side 20, a front 22, and a rear 24. The panel is a sandwich consisting of five acoustical board layers 26. The acoustical board layers are joined by ballistic material layers 28. The acoustical board layers and ballistic material layers are offset longitudinally and laterally (essentially diagonally) from adjacent layers to form dovetails at the top, bottom, left end, and right end.

In the current embodiment, the ballistic material layers are made of a polymer composite resin mixed with multiple layers of a fiberglass mesh fabric material. The polymer composite resin binding agent bonds the multiple layers of fiberglass mesh to stop the penetration of projectiles. The two outer layers of the design drastically slow a projectile without capturing it. The inner layers of the ballistic material are designed to stop and capture projectiles. Each ballistic layer is three-quarter inch thick.

The acoustical board layers are made of wood fibers having a typical length of 12 inches and width of 3 mm, mixed with Portland cement, with an open mat configuration of 9 lbs./sq. ft. density. Each acoustical board layer is 4 inches thick. The acoustical board is designed so that the outermost acoustical board layer accepts projectile penetration and causes some decrease in projectile velocity before the projectile contacts the first layer of ballistic material. Because the projectile has lost some velocity in the outermost acoustical board layer and first layer of ballistic material, the projectile may yaw and splinter as it penetrates the second acoustical board layer. A 5.56 mm projectile is generally stopped by contact with the second layer of ballistic material. A 7.62 mm round is generally stopped before the third layer of ballistic material. Although the panels are not intended for direct intention fire, they are designed to stop all 5.56 mm and 7.62 mm rounds before the third layer of ballistic material when fired from one side of the panel at 90°. The ballistic wall is made of noncombustible materials and does not have any metal components, so the ballistic wall will not produce metal shrapnel if exploded. The ballistic material layer will melt if it is raised to a sufficiently high temperature, but it will not burn.

Figure 5:
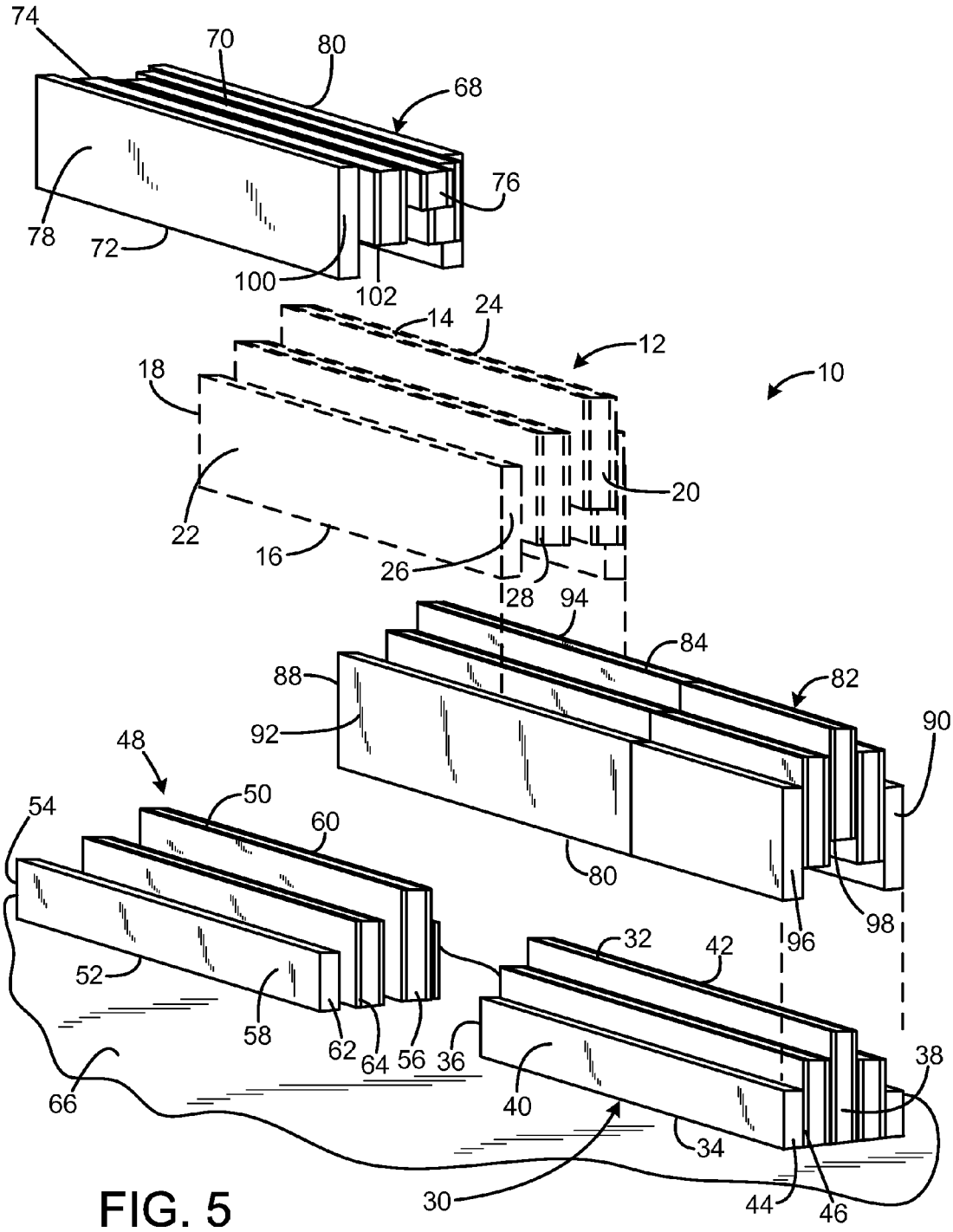
FIG. 5 is a front isometric exploded view of the current embodiment of the ballistic wall constructed in accordance with the principles of the present invention
Figure 6:
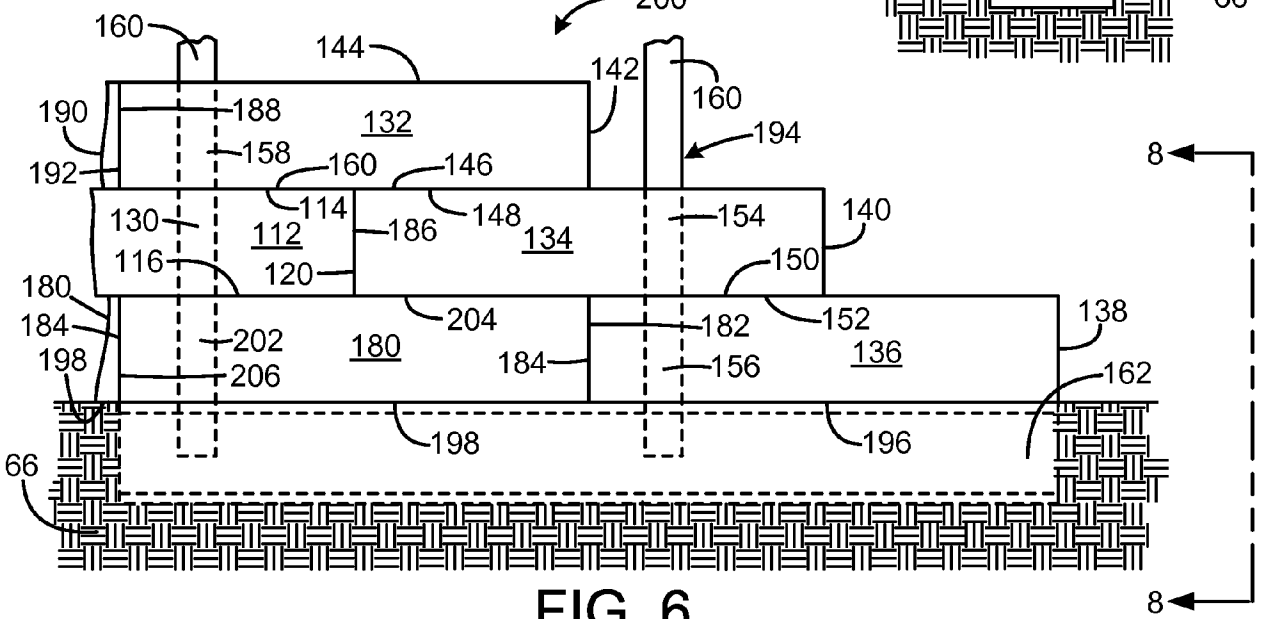
FIG. 6 is a front view of a first alternative embodiment of the ballistic wall constructed in accordance with the principles of the present invention.

FIG. 5 illustrates the improved ballistic wall 10 of the present invention. More particularly, the ballistic wall consists of one or more panels 12 dovetailed to adjacent panels to create a structure. The panels and their individual acoustical board layers 26 and ballistic material layers 28 are vertically and horizontally offset to avoid the creation of seams that can be easily penetrated by a projectile. As also shown in FIG. 6, the panels are assembled in horizontal rows, with the vertical joints offset in the manner of a bricklayer's "running bond."

In order to provide a stable base and a squared off perimeter, panels 12 are modified to form specialized bottom pieces, end pieces, and cap pieces. In FIG. 5, examples of a right end bottom piece 30, a middle bottom piece 48, a right end piece 82, and a middle cap piece 68 are shown. The right end bottom piece is identical to a panel 12 except for its shape. The right end bottom piece has a flat bottom 34 to provide stable contact with the ground 66. The right side 38 of the acoustical board layers 44 and ballistic layers 46 are cut off flush vertically. The left side 36 is dovetailed to receive the right side 56 of the middle bottom piece 48.

The middle bottom piece 48 is identical to a panel 12 except for its shape. The middle bottom piece has a flat bottom 52 to provide stable contact with the ground 66. A left end bottom piece (not shown) is substantially identical to the middle bottom piece except that the left side is not dovetailed to provide a squared off perimeter.

The tops 32 and 50 of the right end bottom piece and middle bottom piece are dovetailed to receive the bottom 86 of the right end piece 82. The right end piece is identical to a panel 12 except for its shape. The right side 90 of the acoustical board layers 96 and ballistic layers 98 are cut off flush vertically. The top 84 is dovetailed to receive the bottom 16 of a panel 12 and/or an additional right end piece and/or a right end cap piece (not shown) depending upon the desired height and length of the ballistic wall 10. The left side 88 is dovetailed to receive the right side 20 of a panel 12 or a left end piece (not shown). A left end piece is substantially identical to a panel 12 except that the left side is not dovetailed to provide a squared off perimeter.

The ballistic wall 10 is topped by cap pieces. A middle cap piece 68 is identical to a panel 12 except for its shape. The top 70 of the acoustical board layers 100 and ballistic layers 102 is cut off flush horizontally. The bottom 72 is dovetailed to fit onto the tops of lower panels. A right cap piece (not shown) additionally has the right side cut off flush vertically. A left cap piece (not shown) additionally has the left side cut off flush vertically.

The front 40, rear 42, front 58, rear 60, front 92, rear 94, front 22, rear 24, and front 78 and rear 80 of the right end bottom piece, middle bottom piece, right end piece, panel, and cap piece all fit together to form a uniform vertical surface when the ballistic wall is assembled. Each piece is 2 feet wide, which enables pieces to be stacked vertically in excess of 8 feet without a foundation or structural support for temporary applications and/or when quick deployment is essential. The pieces have varying lengths to avoid the creation of seams that can be easily penetrated by a projectile. The ballistic wall can be stacked around a building to limit the potential for destruction by an explosive detonated in front of the ballistic wall or can be used to block off streets.

Figure 8:
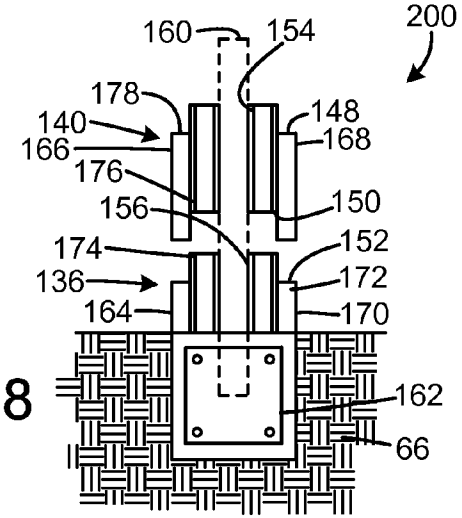
FIG. 8 is a cross-section view taken along the line 8-8 of FIG. 6.
Figure 7:
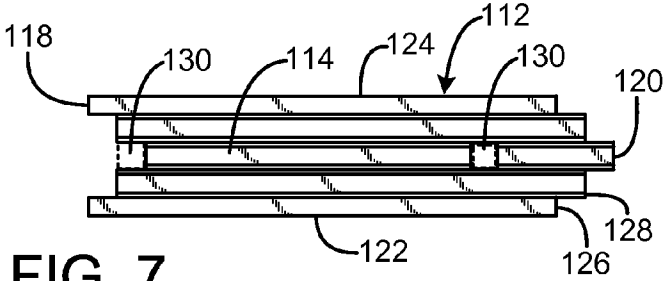
FIG. 7 is a top view of a first alternative embodiment of the panel constructed in accordance with the principles of the present invention.

FIGS. 6-8 illustrate a first alternative embodiment of the improved ballistic wall 200 of the present invention. More particularly, the ballistic wall is substantially identical to the ballistic wall 10 in that the wall 200 consists of one or more panels 112 dovetailed to adjacent panels. However, each panel has one or more cavities 130 and is mounted on a tubular frame 194 to create a structure. The panels and their individual acoustical board layers 126 and ballistic material layers 128 are vertically and horizontally offset to avoid the creation of seams that can be easily penetrated by a projectile.

In order to provide a stable base and a squared off perimeter, panels 12 are modified to form specialized bottom pieces, end pieces, and cap pieces. In FIG. 6, examples of a right end bottom piece 136, a middle bottom piece 180, a right end piece 134, and a right end cap piece 132 are shown. The right end bottom piece is identical to a panel 112 except for its shape. The right end bottom piece has a flat bottom 196 to provide stable contact with the ground 66. The right side 138 of the acoustical board layers 172 and ballistic layers 174 are cut off flush vertically. The left side 182 is dovetailed to receive the right side 184 of the middle bottom piece 180. The left side also has a cavity 156 that receives a vertical tube 160.

The middle bottom piece 180 is identical to a panel 112 except for its shape. The middle bottom piece has a flat bottom 198 to provide stable contact with the ground 66. The left side 206 is dovetailed to receive the right side 184 of an additional middle bottom piece or the right side of a left end bottom piece. A left end bottom piece (not shown) is substantially identical to the middle bottom piece except that the left side is not dovetailed to provide a squared off perimeter. The left side also has a cavity 202 that receives a vertical tube 160.

The tops 152 and 204 of the right end bottom piece and middle bottom piece are dovetailed to fit into the bottom 150 of the right end piece 134. The right end piece is identical to a panel 112 except for its shape. The right side 140 of the acoustical board layers 178 and ballistic layers 176 is cut off flush vertically. The top 148 is dovetailed to fit into the bottom 116 of a panel 112 and/or an additional right end piece and/or a right end cap piece (not shown) depending upon the desired height and length of the ballistic wall 200. The left side 186 is dovetailed to receive the right side 120 of a panel 112 or a left end piece (not shown). A left end piece is substantially identical to a panel 112 except that the left side is not dovetailed to provide a squared off perimeter. The right side 140 also has a cavity 154 that receives a vertical tube 160.

The ballistic wall 200 is topped by cap pieces. A right end cap piece 132 is identical to a panel 112 except for its shape. The top 144 of the acoustical board layers and ballistic layers is cut off flush horizontally. The bottom 146 is dovetailed to fit onto the tops of lower panels. The right side 142 is cut off flush vertically. A left cap piece (not shown) instead has the left side cut off flush vertically. The left side 188 also has a cavity 158 that receives a vertical tube 160.

The front 164, rear 170, front 166, rear 168, front 122, rear 124 of the right end bottom piece, right end piece, and panel, and the front and rears of the middle bottom piece and the right end cap piece all fit together to form a uniform vertical surface when the ballistic wall is assembled. Each piece is 2 feet wide, which enables pieces to be stacked vertically in excess of 8 feet. The pieces have varying lengths to avoid the creation of seams that can be easily penetrated by a projectile. The vertical 4 inch in diameter tube steel and horizontal foundation 162 that is buried in the ground 66 are intended for use in outdoor range applications. The tubes and foundation provide stability for wind loads up to 90 mi./h. The cavities that accept the tubes are located the center of each piece's 2 foot width and are 4 inches by 4 inches. The cavities are also positioned within the first 2 feet of each piece's length. The tubes are spaced at 8'6" on center, which enables every piece to receive a tube. Because the pieces are set using a reach lift and placed over the tubes, individual panels can be easily replaced as needed.

Figure 9:
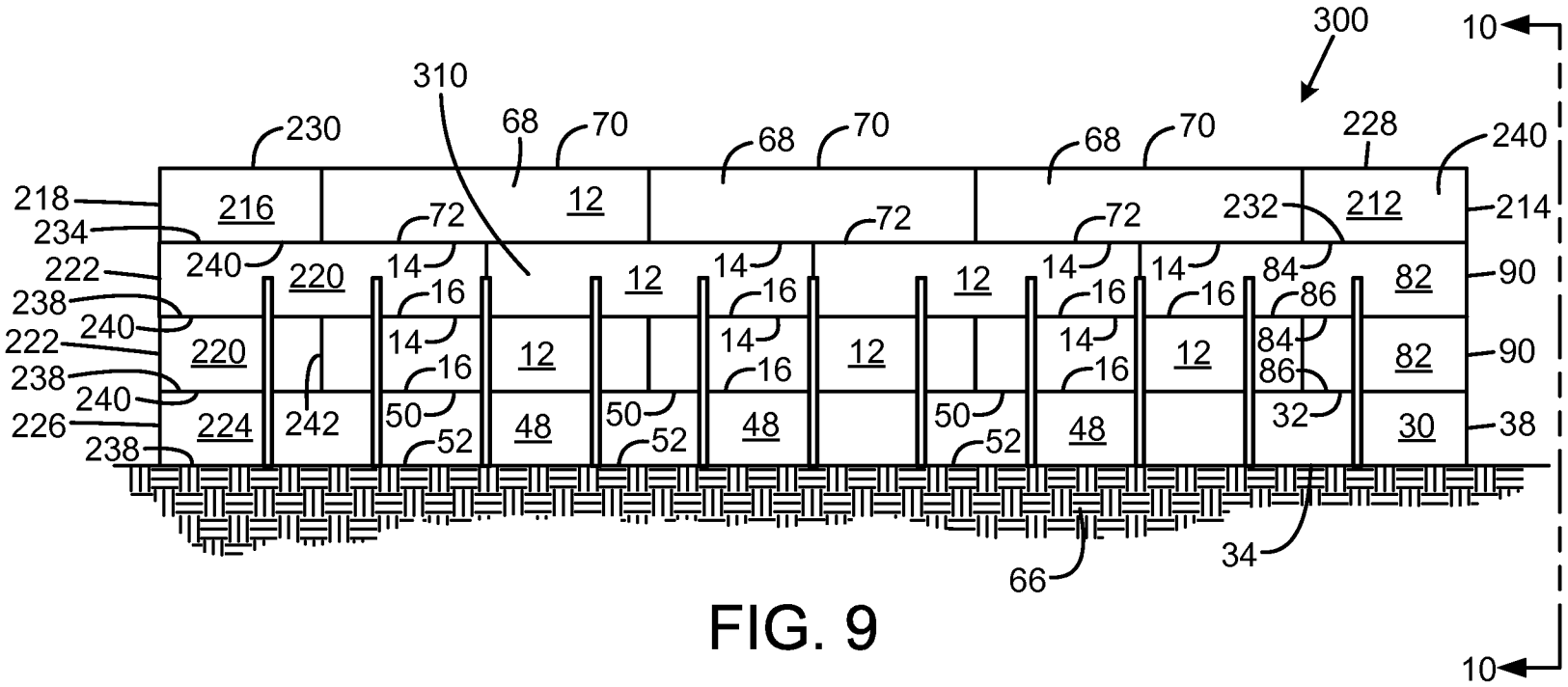
FIG. 9 is a front view of a second alternative embodiment of the ballistic wall constructed in accordance with the principles of the present invention.
Figure 10:
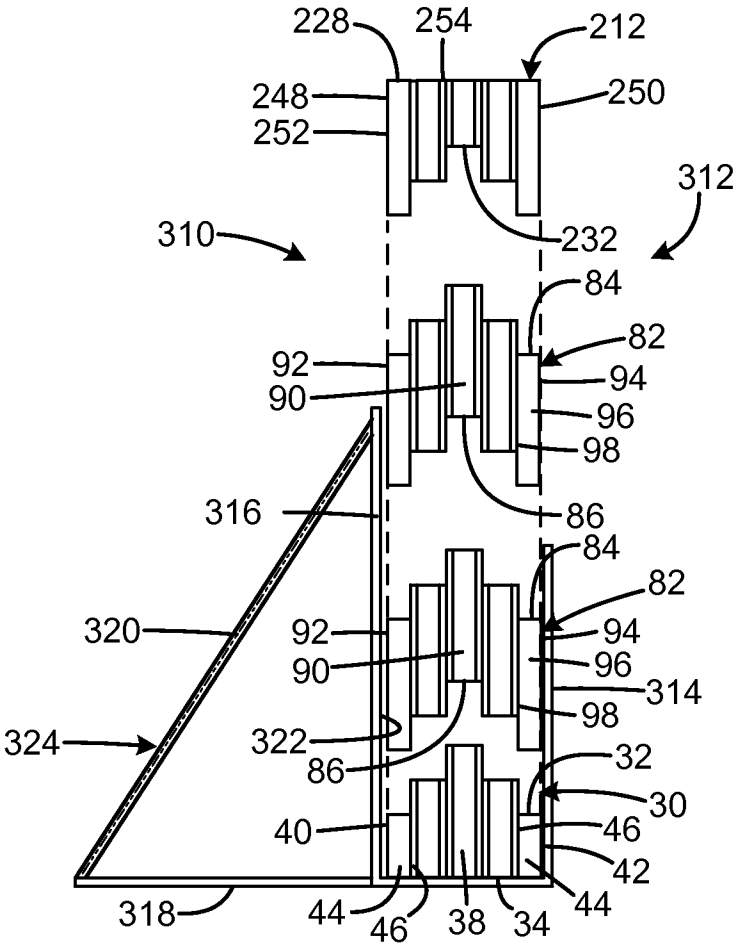
FIG. 10 is a right end exploded view of the second alternative embodiment of the ballistic wall of FIG. 9.
Figure 11:
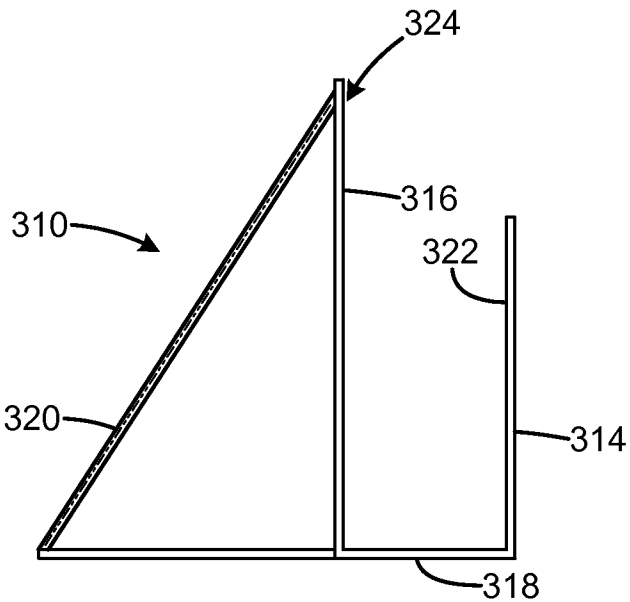
FIG. 11 is a right side view of the support frame of the second alternative embodiment of the ballistic wall of FIG. 9.

FIGS. 9-11 illustrate a second alternative embodiment of the improved ballistic wall 300 of the present invention. More particularly, the ballistic wall is substantially identical to the ballistic wall 10 except for the addition of a support frame 324 to create a structure. The panels and their individual acoustical board layers 26 and ballistic material layers 28 are vertically and horizontally offset to avoid the creation of seams that can be easily penetrated by a projectile.

In order to provide a stable base and a squared off perimeter, panels 12 are modified to form specialized bottom pieces 30, 48, and 224, end pieces 82 and 220, and cap pieces 240, 68, and 216. In FIG. 9, a complete ballistic wall 300 is shown with a right end bottom piece 30, middle bottom pieces 48, a left end bottom piece 224, right end pieces 82, left end pieces 220, a right end cap piece 212, middle cap pieces 68, and a left end cap piece 216. The right end bottom piece is identical to a panel 12 except for its shape. The right end bottom piece has a flat bottom 34 to provide stable contact with the ground 66. The right side 38 of the acoustical board layers 44 and ballistic layers 46 are cut off flush vertically. The left side 36 is dovetailed to receive the right side 56 of the middle bottom piece 48.

The middle bottom piece 48 is identical to a panel 12 except for its shape. The middle bottom piece has a flat bottom 52 to provide stable contact with the ground 66. The left end bottom piece is substantially identical to the middle bottom piece except that the left side 226 is not dovetailed to provide a squared off perimeter. The left end bottom piece has a flat bottom 238 to provide stable contact with the ground 66.

The tops 32, 50, and 236 of the right end bottom piece, middle bottom piece, and left end bottom piece are dovetailed to fit into the bottoms 86, 50, and 238 of the right end piece 82, panels 12, and left end piece 220. The right end piece is identical to a panel 12 except for its shape. The right side 90 of the acoustical board layers 96 and ballistic layers 98 are cut off flush vertically. The top 84 is dovetailed to fit into the bottom 16 of a panel 12 and/or an additional right end piece and/or the bottom 232 of a right end cap piece 212 depending upon the desired height and length of the ballistic wall 10. The left side 88 is dovetailed to receive the right side 20 of a panel 12 or the right side 242 of a left end piece 220. A left end piece is substantially identical to a panel 12 except that the left side 222 is not dovetailed to provide a squared off perimeter.

The ballistic wall 300 is topped by cap pieces. A middle cap piece 68 is identical to a panel 12 except for its shape. The top 70 of the acoustical board layers 100 and ballistic layers 102 is cut off flush horizontally. The bottom 72 is dovetailed to fit onto the tops of lower panels. A right cap piece 212 additionally has the right side 214 of the acoustical board layers 252 and ballistic layers 254 cut off flush vertically. A left cap piece 216 additionally has the left side 218 cut off flush vertically.

The front 40, rear 42, front 58, rear 60, front 92, rear 94, front 22, rear 24, front 78, rear 80, and front 248 and rear 250 of the right end bottom piece, middle bottom piece, right end piece, panel, middle cap piece, and right end cap piece, as well as the fronts and rears of the left end bottom piece, left end piece, and left end cap piece, all fit together to form uniform front 310 and rear 312 vertical surfaces when the ballistic wall 300 is assembled. Each piece is 2 feet wide, and the pieces have varying lengths to avoid the creation of seams that can be easily penetrated by a projectile.

The ballistic wall 300 is placed within the U-shaped channel 322 of a support frame 324 to prevent the ballistic wall from being tipped over in a riot control situation. The support frame has a rear plate 314, a bottom plate 318, a front plate 316, and a rod 320. The rear plate, bottom plate, and front plate define the U-shaped channel. The rod connects one end of the bottom plate to the top of the front plate. The support frame enables pieces to be stacked vertically in excess of 12 feet.

Figure 12:
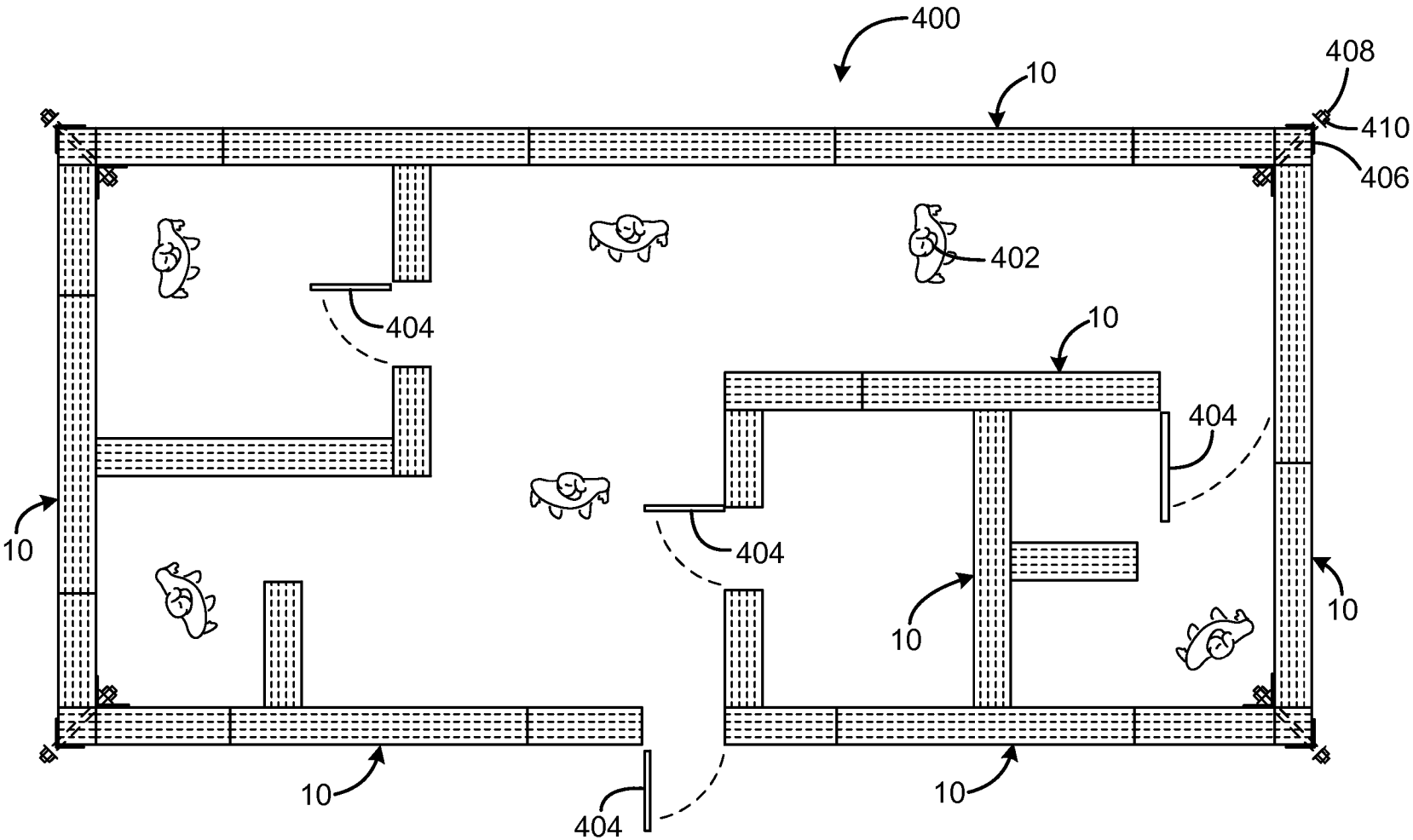
FIG. 12 is a top view of the current embodiment of the ballistic wall of FIG. 5 configured to form a shoot house.

FIG. 12 illustrates multiple improved ballistic walls 10 of FIG. 1 arranged in a shoot house configuration 400. More particularly, the walls 10 are joined together in sections to create rooms and doorways 404 of various sizes. Targets 402 can be positioned wherever desired within the shoot house. The outermost corners of the shoot house are secured by brackets 406, bolts 410, and nuts 408.

While current embodiments of the ballistic wall have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although providing ballistic protection with a small footprint and eliminating lead remediation has been described, it should be appreciated that the ballistic wall herein described is also suitable for reducing gunfire sound levels by eliminating sound reflections and reverberations because of its sound absorption properties.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ballistic wall system comprising:

a plurality of interlocking blocks;

each block having an inner portion having opposed major faces, and an outer portion overlaying at least one of the major faces;

the inner portion being a body having a plurality of planar subportions;

each subportion of the inner portion having a periphery including opposed horizontal edges, and opposed vertical edges;

the peripheries being offset from each other to form a first tongue at a first one of the horizontal edges and a first groove at an opposed one of the horizontal edges, and to form a second tongue at a first one of the vertical edges and a second groove at an opposed one of the vertical edges;

the inner portion having a first ballistic characteristic;

the outer portion being horizontally and vertically offset from a periphery of the major face of the inner portion to which the outer portion is attached, the outer portion having a second ballistic characteristic; and wherein each subportion of the inner portion includes a plurality of layers, each layer having a different ballistic characteristic.

2. The ballistic wall system of claim 1 wherein the first ballistic characteristic has a greater resistance to bullet penetration than the second ballistic characteristic.

3. The ballistic wall system of claim 1 wherein the second ballistic characteristic is to permit bullets to penetrate and to resist transmission of fragments.

4. The ballistic wall system of claim 1 including an outer portion on each major face of the inner portion.

5. The ballistic wall system of claim 4 wherein the outer portions have lower peripheral edges, and wherein the lower peripheral edges of all of the outer portions are positioned at the same level when the block is vertically positioned, such that a stable base is provided.

6. The ballistic wall system of claim 1 wherein the inner portion includes a plurality of subpanels laminated together.

7. The ballistic wall system of claim 1 wherein the outer portion has a periphery offset from the periphery of the subportions of the inner portion the outer portion overlays.

8. The ballistic wall system of claim 1 wherein the outer portion has a first acoustic property and the inner portion has a second acoustic property.

9. The ballistic wall system of claim 8, wherein the first acoustic property has a greater absorption of sound than the second acoustic property.

10. The ballistic wall system of claim 1 wherein the planar subportions have a middle subportion between opposed outer subportions, and wherein the middle subportion has a periphery horizontally and vertically offset from the outer subportions of the inner portion.

11. The ballistic wall system of claim 1 wherein each of the subportions and the outer portions has a common peripheral shape and dimension such that when the blocks are assembled, there are no gaps between any of the portions.

12. The ballistic wall system of claim 1 wherein each of the subportions and the outer portions has a common peripheral shape and dimension such that when the blocks are assembled, the blocks interlock with adjacent blocks.

13. A ballistic wall system comprising:

a plurality of interlocking blocks;

each block having a periphery;

a first portion of the periphery of each block having a protruding vertical tongue;

a second portion of the periphery of each block defining a vertical groove sized to receive the vertical tongue;

a third portion of the periphery of each block having a protruding horizontal tongue;

a fourth portion of the periphery of each block defining a horizontal groove sized to receive the horizontal tongue;

a widest portion of the horizontal tongues being narrower than a narrowest portion of the horizontal grooves, such that the horizontal tongues can be inserted into and removed from the horizontal grooves vertically;

the vertical and horizontal tongues and vertical and horizontal grooves of adjacent blocks being mated to each other to form an interlocked structure;

each block having an inner portion having a first ballistic characteristic, and an outer portion having a second ballistic characteristic, the first ballistic characteristic being more resistant to bullet penetration than the second ballistic characteristic, and the second ballistic characteristic being resistant to transmission of bullet fragments; and wherein the inner portion includes a plurality of subpanels laminated together, each subpanel having a different ballistic characteristic.

14. The ballistic wall system of claim 13 wherein the inner portion has offset peripheral edges, such that edges of the inner portion overlap with edges of adjacent blocks to avoid creating straight seams through which bullets may penetrate between the inner portions.

15. The ballistic wall system of claim 13 wherein the outer portions of each block has a lower peripheral edge, and wherein the lower peripheral edges of the outer portions are positioned at the same level when each block is vertically positioned, such that a stable base is provided.

16. The ballistic wall system of claim 13 wherein the outer portion has a periphery offset from a periphery of the inner portion the outer portion overlays.

17. The ballistic wall system of claim 13 wherein the outer portion has a first acoustic property and the inner portion has a second acoustic property.

18. The ballistic wall system of claim 13, wherein the first acoustic property has a greater absorption of sound than the second acoustic property.

* * * * *